US008618390B2

(12) United States Patent
Ruck et al.

(10) Patent No.: US 8,618,390 B2
(45) Date of Patent: Dec. 31, 2013

(54) ADJUSTABLE STRAP-ON CAPOTASTO WITH REPLACEABLE STRAP AND METHOD OF USE

(76) Inventors: Robert Ruck, Eugene, OR (US); Peter Baime, Milwakee, WI (US)

( * ) Notice: Subject to any disclaimer, the term of this patent is extended or adjusted under 35 U.S.C. 154(b) by 4 days.

(21) Appl. No.: 13/362,453

(22) Filed: Jan. 31, 2012

(65) Prior Publication Data

US 2013/0192442 A1 Aug. 1, 2013

(51) Int. Cl.
*G10D 3/00* (2006.01)

(52) U.S. Cl.
USPC ..... 84/318

(58) Field of Classification Search
USPC ..... 84/318
See application file for complete search history.

(56) References Cited

U.S. PATENT DOCUMENTS

| | | | | | |
|---|---|---|---|---|---|
| 1,788,636 | A | * | 1/1931 | Russell | 84/318 |
| 3,185,012 | A | * | 5/1965 | Dunlop | 84/318 |
| 3,504,589 | A | * | 4/1970 | Wowries | 84/318 |
| 3,598,012 | A | * | 8/1971 | Dunlop | 84/288 |
| 3,722,346 | A | * | 3/1973 | Valentino | 84/318 |
| 4,252,046 | A | * | 2/1981 | Myerson et al. | 84/318 |
| 4,334,457 | A | * | 6/1982 | Spoonts, III | 84/318 |
| D270,918 | S | * | 10/1983 | Williamson et al. | D17/20 |
| 4,412,472 | A | * | 11/1983 | Welch | 84/318 |
| 4,475,433 | A | * | 10/1984 | Williamson et al. | 84/318 |
| 2010/0275757 | A1 | * | 11/2010 | Hallet et al. | 84/318 |

* cited by examiner

*Primary Examiner* — Robert W Horn
(74) *Attorney, Agent, or Firm* — John K. Buche; Buche & Associates, P.C.

(57) ABSTRACT

Generally disclosed is a capo and related methods of use. Operably, the capo may be secured to the neck of stringed musical instruments to barre its strings. Suitably, the capo may (1) generally feature a replaceable and adjustable strap, (2) be configured for quick relocation among the frets of a stringed musical instrument with a tapering neck, and (3) be configured for quick adjustment of the pressure applied to strings barred thereby.

20 Claims, 6 Drawing Sheets

ADJUSTABLE STRAP-ON CAPOTASTO WITH REPLACEABLE STRAP AND METHOD OF USE

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of Invention

This invention relates to the field of capotastos for use with stringed instruments.

2. Background of the Invention

The present disclosure relates to attachments for stringed instruments, more specifically capos and improvements thereto.

Often musicians playing stringed instruments desire to raise the pitch of the instrument. This is common with fretted instruments, such as guitars, mandolins, and banjos, among others. One way musicians have accomplished achieving a higher pitch is to attach a device known as a capotasto, also called a "capo" for short. A capo can be attached to the neck of a stringed instrument, usually one which is fretted, in such a manner so as to press the strings to the fret, or the neck itself in the case of an unfretted instrument. Pressing the strings in such a manner effectively shortens the portion of the string actually played with each strum, thus resulting in a higher pitch. Playing the instrument in a higher pitch allows the musician to perform a piece in a certain key using different finger positions as compared to the "open" position (i.e., without the use of a capo).

There have been various styles of capos in the prior art. One common type of capo is the "trigger-style" capo. This style typically has two bars, one rubber-covered to barre the strings (i.e., press the strings against the fret), and another which presses against the back of the neck of the instrument to secure the capo to the instrument. Commonly, the two bars may be connected via a hinge mechanism, and utilize a spring or screw mechanism to securely fasten the capo to the instrument. Although such capos may offer the benefit of a quick-release mechanism, they also typically lack the ability to easily adjust the pressure of the capo against the strings. Such capos apply the maximum pressure to hold strings against the frets, which can negatively impact the tuning of some guitars.

Another common capo type is the strap-on capo. These types of capos typically have a rubber-covered bar which is placed across the strings in order to barre them, and then a strap attached to either end of the bar, and wrapped around the back of the neck of the instrument, to firmly secure the capo to the instrument. Straps for such capos are typically composed of elastic or fabric, and can be adjusted to set tightness through a ratcheting or clamping mechanism. A typical strap-on capo is exemplified in U.S. Pat. No. 3,185,012 to Dunlop. The strap allows for even pressure against the strings. However, because such straps are stretched, over time they can suffer a loss of elasticity and eventual failure due to excessive wear. When the strap breaks or becomes incapable of providing adequate tension, the entire capo needs to be replaced.

SUMMARY OF THE INVENTION

Accordingly, it is an object of the present disclosure to provide an easily adjustable capo which provides for the application of even pressure against the strings in order to barre them and raise the pitch of the instrument.

It is another object of the present disclosure to provide a capo capable of utilizing an easily replaceable strap.

It is yet another object of the present disclosure to provide a capo capable of being quickly adjustable from the one fret to another without the need to fully detach and reattach the strap and clamping mechanism.

It is yet another object of the present disclosure to provide a capo capable of easily adjusting the pressure applied to barre the strings against the fret or neck of the instrument.

A preferred embodiment capable of meeting said objectives may be a capo device that is comprised of four main components: (a) a bar; (b) a hook; (c) a strap; and (d) a latch lever. When assembled, the strap may be adjustably and releasably coupled at one end to a midsection of the latch lever and at another end to the hook; and, the bar may be configured at one end to pivotally connect to the latch lever and at another end to connect to the hook. The assembled device will typically operate as follows: the bar is placed on the neck of a stringed instrument, over the strings; the latch lever is pivotally connected to the bar; the strap is pulled across the underside of the neck; the hook is received at the other end of the bar so that the strap is strung underneath the neck between to ends of the bar; the latch lever may be pivoted toward the bar so that the strap is cinched tight to barre the strings of the instrument via the bar. Suitably, the pivot point of the lever and the bar may be adjustable so that the device may be quickly adjustable from either (a) one fret to another or (b) one pressure to another.

BRIEF DESCRIPTION OF THE FIGS.

Other objectives of the disclosure will become apparent to those skilled in the art once the invention has been shown and described. The manner in which these objectives and other desirable characteristics can be obtained is explained in the following description and attached FIGS. in which.

It is to be noted, however, that the appended FIGS. illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFFERED EMBODIMENTS

Generally disclosed is a capo. Operably, the capo may be secured to the neck of stringed musical instruments to barre its strings. Suitably, the capo may (1) generally feature a replaceable and adjustable strap, (2) be configured for quick relocation among the frets of a stringed musical instrument with a tapering neck, and (3) be configured for quick adjustment of the pressure applied to strings barred thereby. The more specific details of the disclosed capo are disclosed with reference to the drawings.

Figure 1:
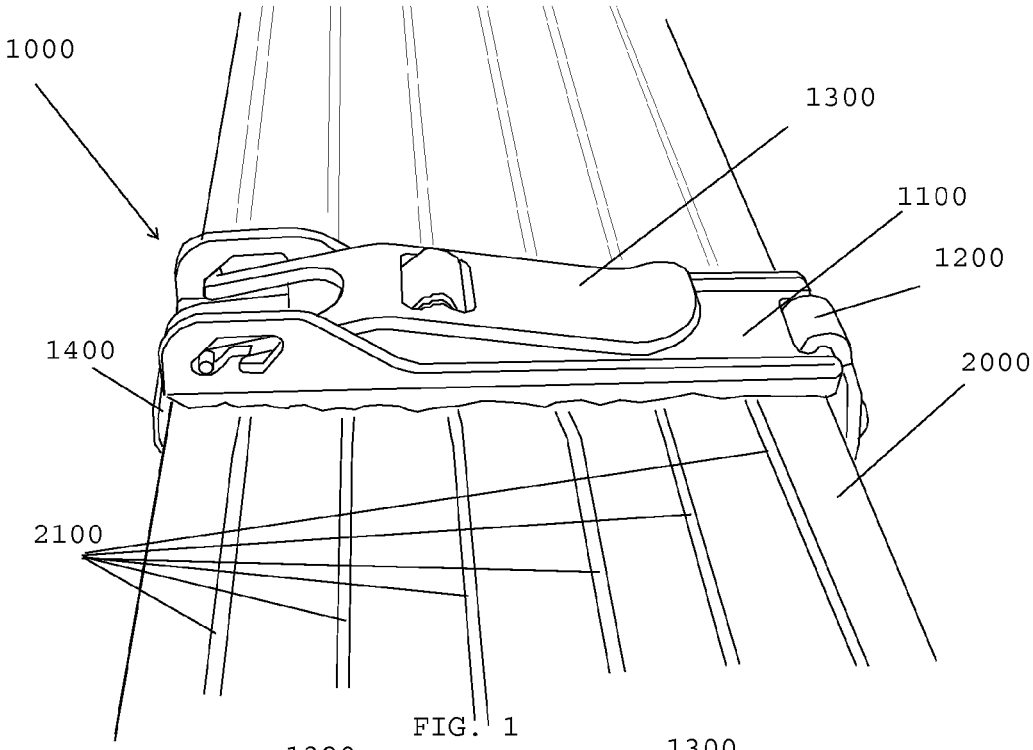
FIG. 1 is a perspective view of a capo 1000 on the neck 2000 of a stringed musical instrument (strings designated by numeral 2100)

FIG. 1 is a perspective view of a capo 1000 installed on the neck 2000 of a stringed musical instrument to barre its strings 2100. As can be seen in the FIG., the capo 1000 is comprised of four main components: (a) a bar 1100; (b) a hook 1200; (c) a strap 1400; and (d) a latch lever 1300. FIGS. 2A through 2B are perspective views of said components respectively.

FIG. 2A is a perspective view of the bar 1100. Referring to FIG. 2A in view of FIG. 1, the bar 1100 has at least one surface 1110 operationally configured to compress the strings 2100 of a stringed instrument against the neck 2000 of that instrument typically at or near a desired fret location on said neck 2000. That surface 1100 may or may not be coated with a vibration-absorbing substance 1111 such as rubber, plastic, wood, fabric, carpet or similar material. One end of said bar is operationally configured with a slot 1120 that is preferably, as discussed below, configured to receive and secure a curved head 1220 of a hook 1200 (see, e.g., FIGS. 1 and 2B). The opposite end of said bar 1100 is, as discussed below in more detail, operationally configured with one or more notches 1130 capable of rotably receiving the end of a latch lever 1400. It should be noted: although the FIGS. only depict two notches 1130 extending along a portion of the bar 1100, any number of notches 1130 could be provided along a majority of the length of the bar 1100.

FIG. 2B depicts a perspective of the hook 1200. Referring now to FIG. 2B in view of FIG. 1, the hook 1200 is defined at one end by a strap fastener 1210 and at another end by a curved head 1220. In the FIGS., the strap fastener 1210 is defined by two parallel slots whereby a strap may be secured thereto via threaded insertion (e.g., insertion of the strap tip through one slot and out the other slot or insertion of the strap tip through one slot, out other slot, and then back through the first) or tying. Although depicted as two parallel slots, the strap fastener 1200 may be anything capable of releasably and adjustably securing one end of a strap thereto. For example, the strap fastener 1210 may be a buckle or clasp. The curved head 1220 is preferably configured to slide into the hook slot 1120 of the bar 1000.

Figure 2C:
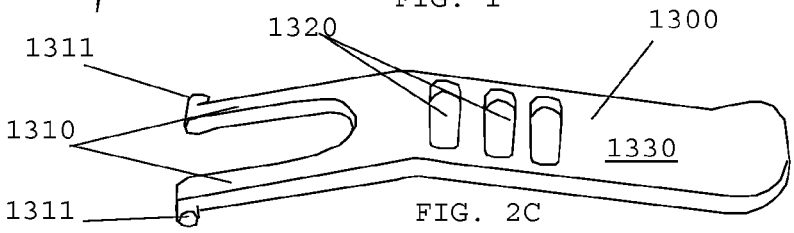
FIG. 2C is a perspective view of a strap 1300.
Figure 2A:
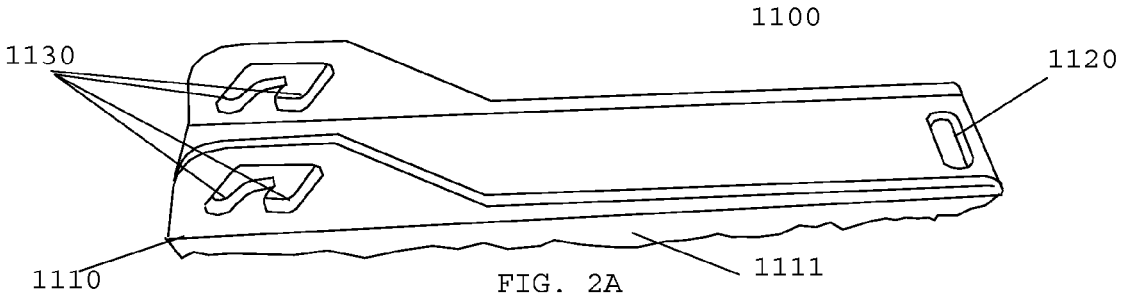
FIG. 2A is a perspective view of a bar 1100.
Figure 2B:
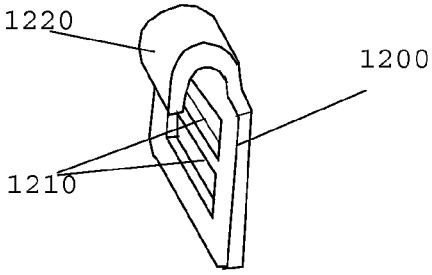
FIG. 2B is a perspective view of a hook 1200.

FIG. 2C depicts the latch lever 1300. As seen in the FIG., the latch lever 1300 may preferably feature legs 1310, a strap fastener 1320, and a handle 1330. Referring to FIGS. 2C in view of FIG. 1, the strap fastener 1320 of the latch handle 1300 is, like the strap fastener 1210 of the hook 1200, depicted as two parallel slots whereby a strap may be secured thereto via threaded insertion or tying. Although depicted as two parallel slots, the strap fastener 1200 may be anything capable of releasably and adjustably securing one end of a strap thereto. For example, the strap fastener 1210 may be a buckle or clasp.

Still referring to the same FIGS., the legs 1310 may extend outwardly from the strap fastener 1320 and feature a pair of aligned axles 1311. Operably, the axles 1311 may rotatably associate with selected notches 1130 of the bar 1100, such that the latch lever 1400 can rotate about said axles within said selected notches 1130 from: an open position wherein the bar 1100 and the lever latch 1300 generally define oblique planes or perpendicular planes; to a closed position wherein the bar 1100 and lever latch 1300 generally form parallel planes. (Compare, e.g., the different positions illustrated in FIG. 3). The handle 1330 is configured at the other end of the strap fastener 1320 for turning the lever latch 1300 about its axles 1311 within the notches 1130.

Figure 2D:
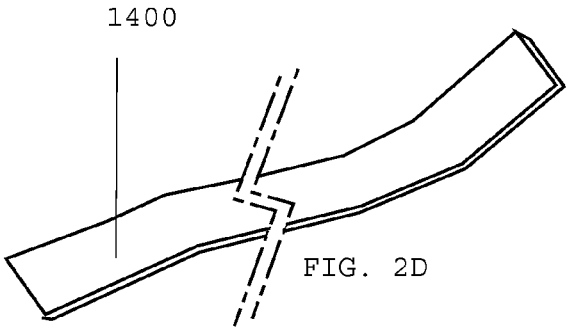
FIG. 2D is a perspective view of a latch lever 1400.

FIG. 2D is a perspective view of the strap 1400. As seen in the FIGS. the strap may be an elongated flap or ribbon, usually of fabric, leather, plastic, rubber, or the like. Referring to FIG. 2D and FIG. 1, the strap 1400 may be adjustably and releasably coupled to the hook 1200 at one end via the strap fastener 1210 and at the other end to the lever latch 1300 via the strap fastener 1310. The strap 1400 may suitably be replaced whenever it is worn out or broken through use thereof or otherwise.

Figure 3:
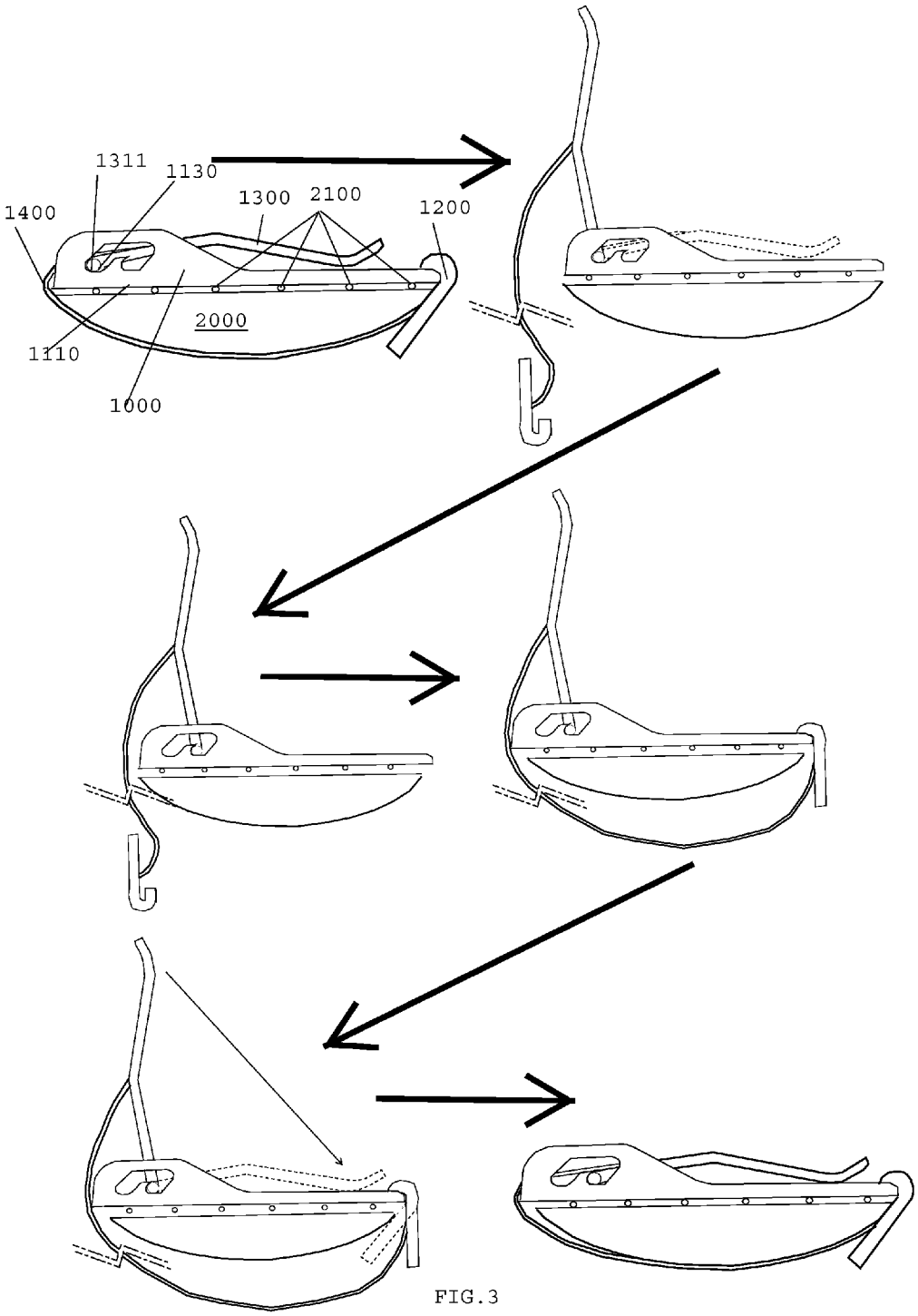
FIG. 3 is flow chart for securing the capo 1000 of FIG. 1 to a wide part of the neck 2000 of a stringed musical instrument.

Referring once again to FIG. 1, the capo 1000 may suitably be installed on the neck 1000 of a stringed musical instrument to barre its strings 1100, usually adjacent to a fret. FIG. 3 is a flow chart for accomplishing such installment. As seen in FIG. 3, a capo 1000 may be operated to barre strings as follows: first, an open capo 1000 may be positioned on the neck 2000 of a stringed musical instrument atop the strings 2100; second, the hook may be wrapped underneath the neck 2000 whereby the curved head 1220 may be inserted into the hook slot 1120 so that the strap 1400 runs slack between the lever latch 1300 and the hook 1200; third the lever latch 1300 may be rotated to a closed position so that the slack strap 1400 may tauten to cinch or barre the strings 2100 against the neck 2100 surface. In other words, when the lever latch 1300 is in the closed position, the bar 1100 is secured against the neck, and the lower surface 1110 of the bar thereby barres the strings against the desired fret, and provides the desired increased pitch level. It should be noted that the pressure of the barre associated with the closed capo 1000 may be adjusted via adjusting the length of the strap 1400 between the lever latch 1300 and hook 1200 via the strap fasteners 1320 and 1210 respectively.

Figure 4:
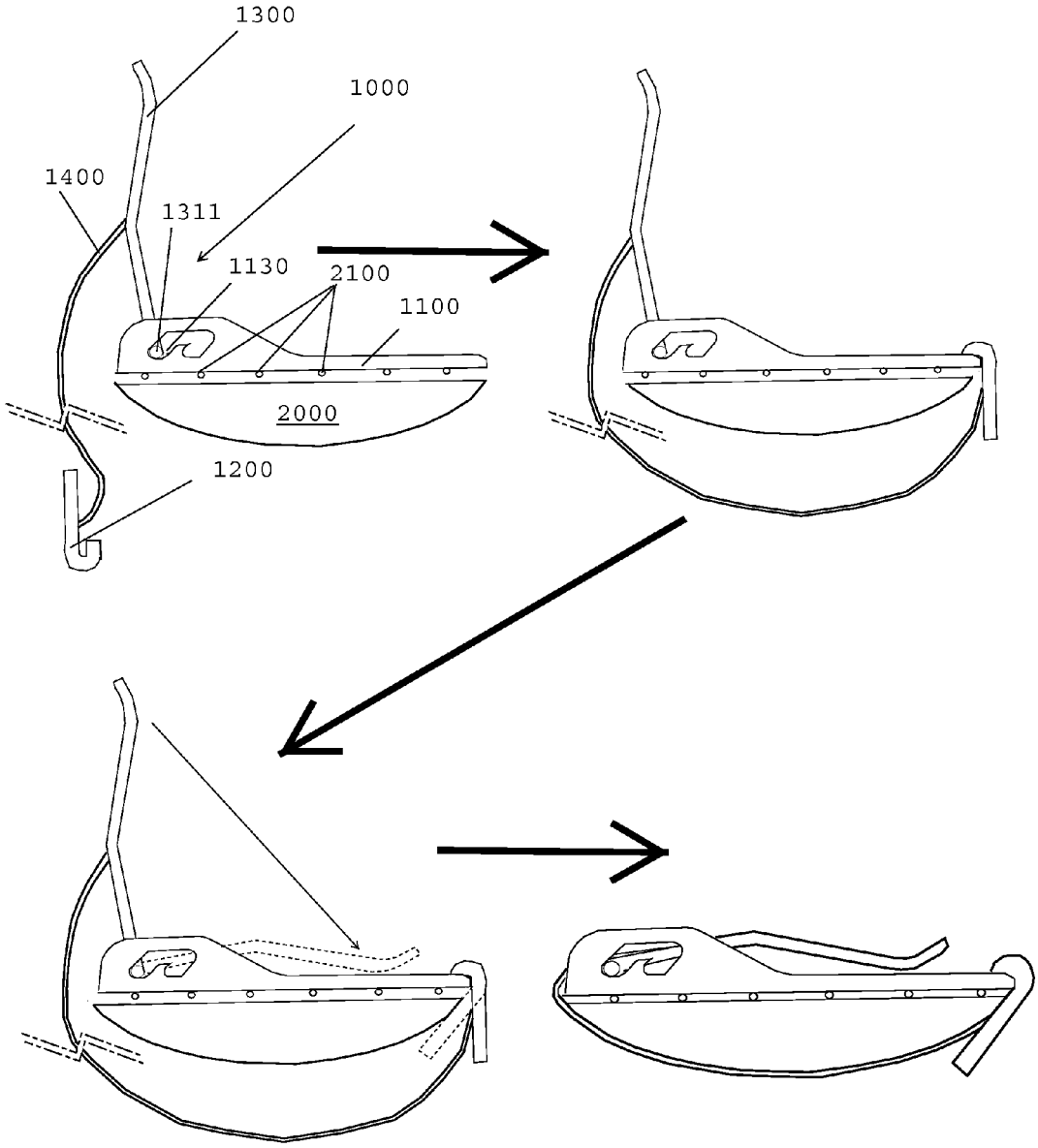
FIG. 4 is a flow chart for securing the capo 1000 of FIG. 1 to a narrow part of the neck 2000 of a stringed musical instrument.

Referring once again to FIG. 2A, the bar 1100 features notches 1130, the notches 1130 of the bar 1100 are configured to pivotally, yet releasably, retain the axels 1311 to the bar 1100. In the preferred embodiment the bar 1100 features a plurality of notches so that the capo 1000 may be used to secure the capo 1000 at various points along the instrument's neck 2000 at various fret positions without adjusting the length of the strap 1400. This feature may be particularly convenient since typical stringed-instrument necks are tapered from wider near the body of the instrument, to narrower at the head of the instrument and multiple notch positions allow for the capo to easily adjust to the varying neck sizes. FIG. 4 is a flow chart for moving the capo 1000 between two locations on the neck 2000 of a stringed musical instrument. As seen in the FIG.: first, a closed capo 100 at the first location along the neck 2000 of the musical instrument may be opened and the hook 1200 removed from the hook slot 1120; second, the axels 1311 of on the legs 1310 of the latch lever 1300 may be moved from a first notch 1130 to a second notch 1130 along the length of the bar 1100; third, the capo 1000 may be positioned on the neck 2000 of a stringed musical instrument atop the strings 2100 at a second position; fourth, the hook may be wrapped underneath the neck 2000 whereby the curved head 1220 may be inserted into the hook slot 1120 so that the strap 1400 runs slack between the lever latch 1300 and the hook 1200; and, fifth, the lever latch 1300 may be rotated to a closed position so that the slack strap 1400 may tauten to cinch or barre the strings 2100 against the neck 2100 surface.

The capo 1000 depicted in FIGS. 1 through 4 may have the following dimensions. The bar 1100 may be fifty-eight millimeters in length, fifteen millimeters wide; and, one-hundred and fifty-six thousandths of a millimeter in thickness. The lever latch 1300 may be forty-four millimeters in length and of the same general thickness as the bar 11000. The notches 1130 of the bar 1100 may preferably be angled at forty five degrees and spaced four millimeters apart with a height of one hundred and twenty-five thousandths of a millimeter.

Figure 5C:
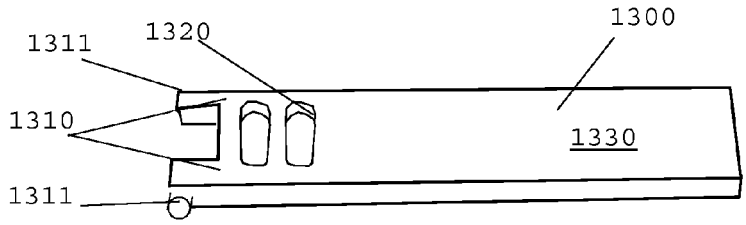
FIG. 5C is a perspective view of another strap 1300.
Figure 6:
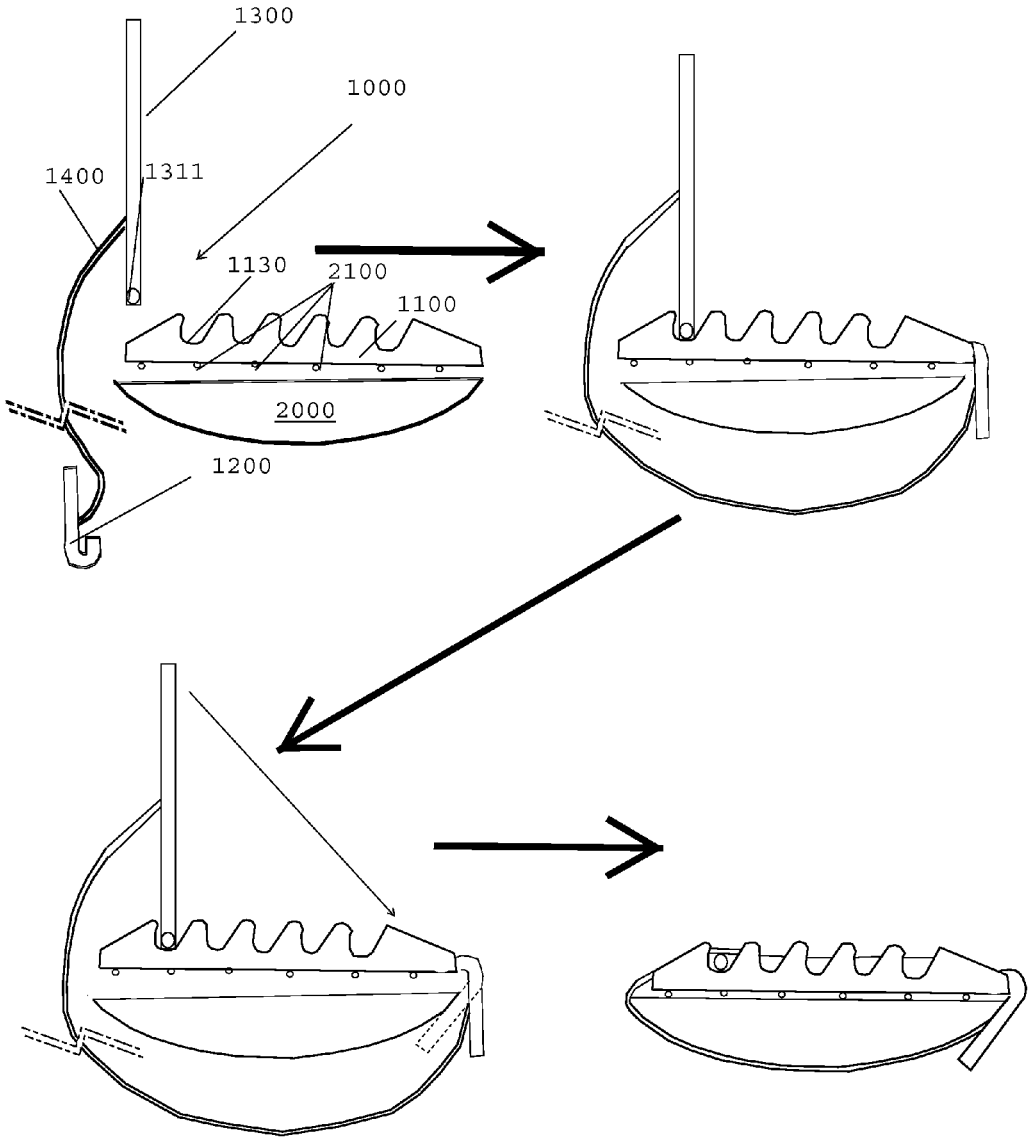
FIG. 6 is a flow chart for securing an alternate embodiment of the capo 1000 to a wide part of the neck 2000 of a stringed musical instrument; and, FIG. 7 is a flow chart for securing the capo 1000 of FIG. 5 to a narrow part of the neck 2000 of a stringed musical instrument.
Figure 7:
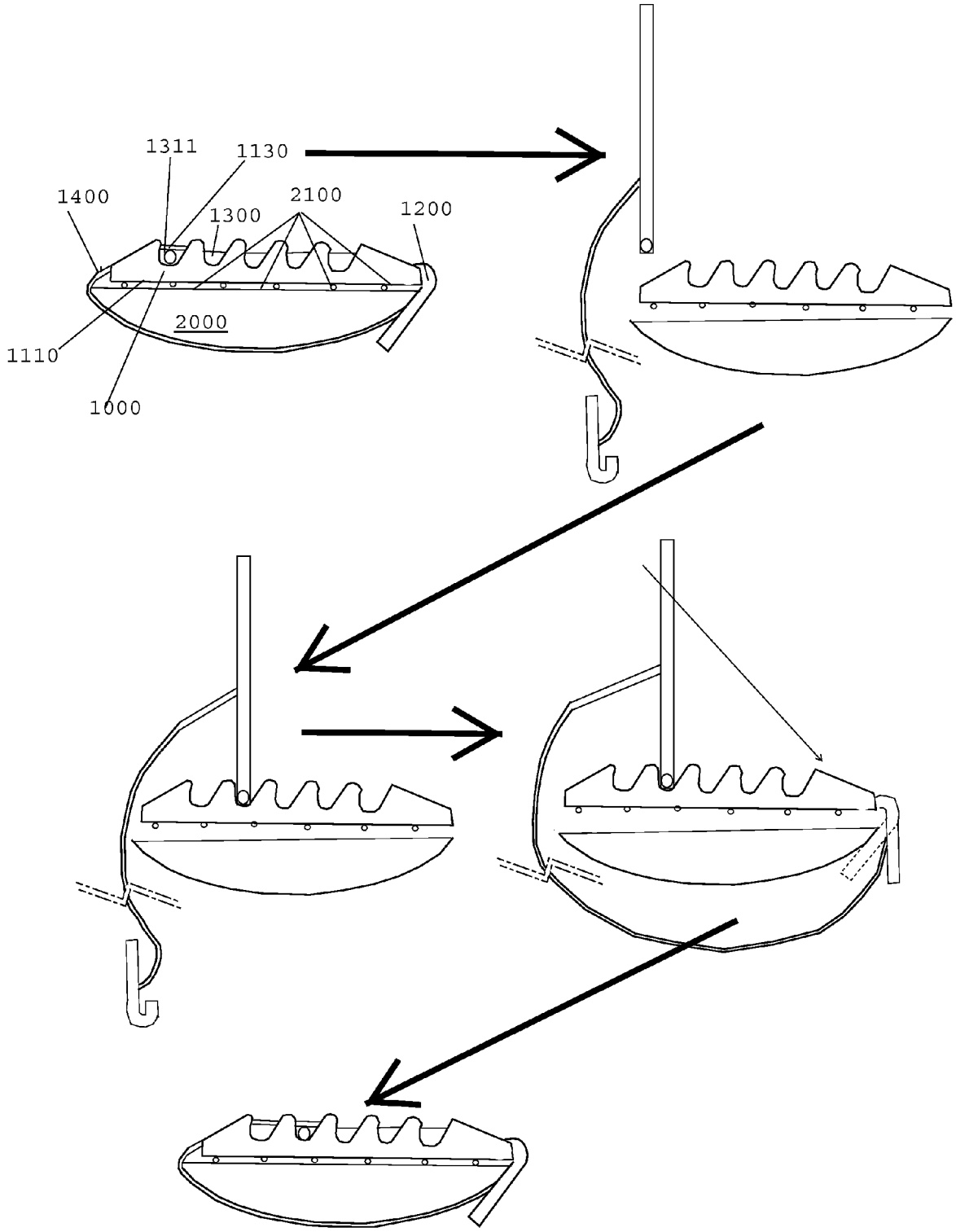

FIGS. 5A through 5D constitute an exploded view of a second embodiment of a capo 1000. FIGS. 6 and 7 illustrate the operation of the capo of FIGS. 5A through 5D. This second example of a capo 1000 may suitably be operably, functionally, and structurally similar to the first embodiment disclosed in connection with FIGS. 1 through 4. For this reason, corresponding numbers from FIGS. 1 through 4 have been used to indicate like components in FIGS. 5A through 5D.

The capo 1000 shown in FIGS. 5A through 5D may be installed on the neck of a stringed musical instrument to barre its strings 2100 in the manner shown in FIGS. 6 and 7. As can be seen in the FIGS., the capo 1000, as with the earlier embodiment, is comprised of four main components: (a) a bar 1100; (b) a hook 1200; (c) a strap 1400; and (d) a latch lever 1300. By comparison, the second embodiment, unlike the embodiment shown in FIGS. 2A through 2D, preferably features a bar 1100 with notches 1130 along the entire length thereof.

Figure 5A:
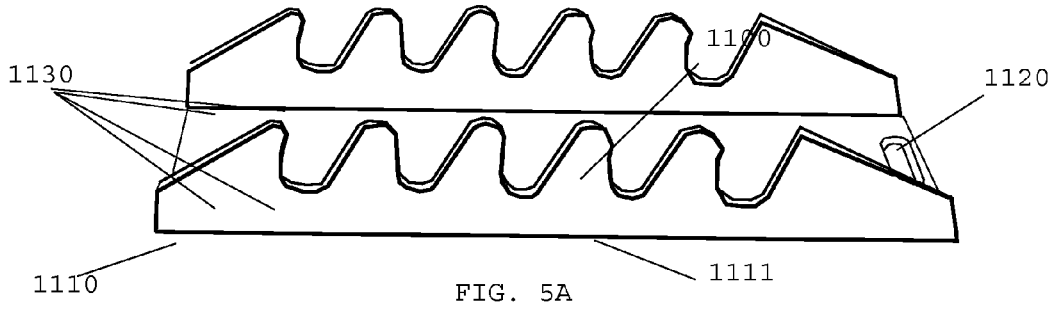
FIG. 5A is a perspective view of another bar 1100.

FIG. 5A is a perspective view of the bar 1100. Referring to FIG. 5A in view of FIGS. 6 and 7, the bar 1100 has at least one surface 1110 operationally configured to compress the strings 2100 of a stringed instrument against the neck 2000 of that instrument typically at or near a desired fret location on said neck 2000. That surface 1100 may or may not be coated with a vibration-absorbing substance 1111 such as rubber, plastic, wood, fabric, carpet or similar material. One end of said bar is operationally configured with a slot 1120 that is preferably, as discussed below, configured to receive and secure a curved head 1220 of a hook 1200 (see, e.g., FIG. 5B). The sides of said bar 1100 are, as discussed below in more detail, operationally configured with one or more notches 1130 capable of rotably receiving the end of a latch lever 1300. It should be noted: although the FIGS. only depict five notches 1130 extending along the sides of the bar 1100, any number of notches 1130 could be provided along a majority of the length of the bar 1100.

Figure 5B:
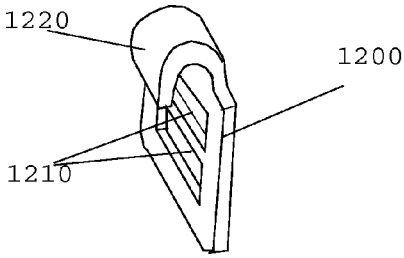
FIG. 5B is a perspective view of another hook 1200.

FIG. 5B depicts a perspective view of the hook 1200. Referring now to FIG. 5B in view of FIGS. 6 and 7, the hook 1200 is defined at one end by a strap fastener 1210 and at another end by a curved head 1220. In the FIGS., the strap fastener 1210 is defined by two parallel slots whereby a strap may be secured thereto via threaded insertion (e.g., insertion of the strap tip through one slot and out the other slot or insertion of the strap tip through one slot, out other slot, and then back through the first) or tying. Although depicted as two parallel slots, the strap fastener 1200 may be anything capable of releasably and adjustably securing one end of a strap thereto. For example, the strap fastener 1210 may be a buckle or clasp. The curved head 1220 is preferably configured to slide into the hook slot 1120 of the bar 1000.

FIG. 5C depicts the latch lever 1300. As seen in the FIG., the latch lever 1300 may preferably feature legs 1310, a strap fastener 1320, and a handle 1330. Referring to FIGS. 2C in view of FIGS. 6 and 7, the strap fastener 1320 of the latch handle 1300 is, like the strap fastener 1210 of the hook 1200, depicted as two parallel slots whereby a strap may be secured thereto via threaded insertion or tying. Although depicted as two parallel slots, the strap fastener 1200 may be anything capable of releasably and adjustably securing one end of a strap thereto. For example, the strap fastener 1210 may be a buckle or clasp.

Still referring to the same FIGS., the legs 1310 may extend outwardly from the strap fastener 1320 and feature a pair of aligned axles 1311. Operably, the axles 1311 may rotatably associate with selected notches 1130 of the bar 1100, such that the latch lever 1400 can rotate about said axles within said selected notches 1130 from: an open position wherein the bar 1100 and the lever latch 1300 generally define oblique planes or perpendicular planes; to a closed position wherein the bar 1100 and lever latch 1300 generally form parallel planes. (Compare, e.g., the different positions illustrated in FIGS. 6 and 7). The handle 1330 is configured at the other end of the strap fastener 1320 for turning the lever latch 1300 about its axles 1311 within the notches 1130. It should be noted that the lever latch 1300 in this embodiment of the capo 1000 may be flat so that the capo may be made thin (e.g., between 3 and 9 millimeters thick) and, thereby, less obstructive to a musician.

Figure 5D:
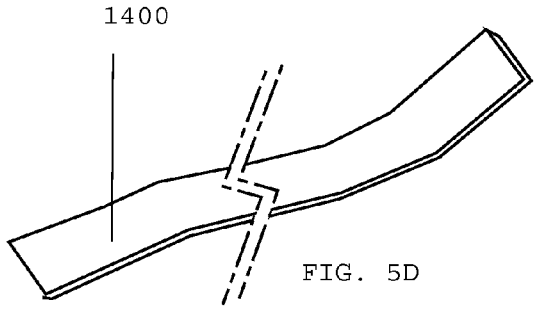
FIG. 5D is a perspective view of another latch lever 1400.

FIG. 5D is a perspective view of the strap 1400. As seen in the FIGS. the strap 1400 may be an elongated flap or ribbon, usually of fabric, leather, plastic, rubber, or the like. Referring to FIG. 2D and FIG. 1, the strap 1400 may be adjustably and releasably coupled to the hook 1200 at one end via the strap fastener 1210 and at the other end to the lever latch 1300 via the strap fastener 1310. The strap 1400 may suitably be replaced whenever it is worn out or broken through use thereof or otherwise.

Referring once again to FIGS. 5A through 7, the capo 1000 may suitably be installed on the neck 1000 of a stringed musical instrument to barre its strings 1100, usually adjacent to a fret. FIG. 6 is a flow chart for accomplishing such installment. As seen in FIG. 6, a capo 1000 may be operated to barre strings as follows: first, a bar 1100 may be positioned on the neck 2000 of a stringed musical instrument atop the strings 2100; second, the axels 1311 of a lever latch 1300 may be provided to aligned notches 1130 to create an open capo 1000 configuration; third, the hook 1200 may be wrapped underneath the neck 2000 whereby the curved head 1220 may be inserted into the hook slot 1120 so that the strap 1400 runs slack between the lever latch 1300 and the hook 1200; fourth, the lever latch 1300 may be rotated to a closed position so that the slack strap 1400 may tauten to cinch or barre the strings 2100 against the neck 2100 surface. In other words, when the lever latch 1300 is in the closed position, the bar 1100 is secured against the neck, and the lower surface 1110 of the bar 1100 thereby barres the strings against the desired fret, and provides the desired increased pitch level. It should be noted that the pressure of the barre associated with the closed capo 1000 may be adjusted via adjusting the length of the strap 1400 between the lever latch 1300 and hook 1200 via the strap fasteners 1320 and 1210 respectively.

Referring once again to FIG. 5A, the bar 1100 features notches 1130, the notches 1130 of the bar 1100 are configured to pivotally, yet releasably, retain the axels 1311 to the bar 1100. In the preferred embodiment the bar 1100 features a plurality of notches so that the capo 1000 may be used to secure the capo 1000 at various points along the instrument's neck 2000 at various fret positions (e.g., at the $1^{st}$ through $8^{th}$ fret) without necessarily adjusting the length of the strap 1400. This feature may be particularly convenient since typical stringed-instrument necks are tapered from wider near the body of the instrument, to narrower at the head of the instrument and multiple notch positions allow for the capo to easily adjust to the varying neck sizes. FIG. 7 is a flow chart for moving the capo 1000 between two locations on the neck 2000 of a stringed musical instrument. As seen in the FIG.: first, a closed capo 100 at the first location along the neck 2000 of the musical instrument may be opened and the hook 1200 removed from the hook slot 1120; second, the axels 1311 of on the legs 1310 of the latch lever 1300 may be moved from a first notch 1130 to a second notch 1130 along the length of the bar 1100; third, the capo 1000 may be positioned on the neck 2000 of a stringed musical instrument atop the strings 2100 at a second position; fourth, the hook may be wrapped underneath the neck 2000 whereby the curved head 1220 may be inserted into the hook slot 1120 so that the strap 1400 runs slack between the lever latch 1300 and the hook 1200; and, fifth, the lever latch 1300 may be rotated to a closed position so that the slack strap 1400 may tauten to cinch or barre the strings 2100 against the neck 2100 surface.

In any preferable embodiment, the capo may be constructed of aluminum or stainless steel (e.g., 0.06 stainless steel) by cutting or molding. This said, the capo disclosed herein may be constructed of any material and by any processes. For example, the bar, hook, and lever latch may be made of metals, plastics, woods, ceramics, or the like, and by molding, injecting casting etcetera. In a preferable embodiment, the capos 1000 disclosed by this specification may be sixty millimeters in length, ten millimeters in width and three to nine millimeters in thickness.

This specification and the appended FIGS. illustrate only typical embodiments or principles disclosed in this application, and therefore, are not to be considered limiting of its scope, for the invention may admit to other equally effective embodiments that will be appreciated by those reasonably skilled in the relevant arts. Any invention disclosed by this specification is defined by the claims.

We claim:

1. A capo assembly comprising:
- a bar with more than one notch and a slot;
- a strap with a first end and a second end;
- a hook with a curved head and a first strap fastener that is adjustably coupled to the first end of the strap;
- a lever latch with at least one axle and a second strap fastener that is adjustably coupled to the second end of the strap;
- wherein the notch(es) are operationally configured to pivotally receive the axle of the lever latch;
- wherein the curved head of the hook is configured to engage the slot of the bar; and,
- wherein pivoting the lever latch within the notch(es) while the curved head is engaged with the slot of the bar tautens the strap.

2. The capo of claim 1 wherein the notches on the bar are within an enclosed space.

3. The capo of claim 1 wherein the said strap fastener has more than one slot to couple the second end of the strap to the strap fastener.

4. The capo of claim 3 wherein said strap fastener features a means for adjusting a second end of the strap within said strap fastener.

5. The bar of claim 1 wherein said bar is:
- fifty-eight millimeters; in length;
- fifteen millimeters wide; and
- one-hundred and fifty-six thousandths of a millimeter in thickness.

6. The lever latch of claim 1 wherein said lever latch is:
- forty-four millimeters in length.

7. The notches of claim 1 wherein said notches are:
- angled at forty five degrees.

8. The notches of claim 7 wherein said notches are:
- spaced four millimeters apart.

9. The notches of claim 8 wherein said notches are:
- a height of one hundred and twenty-five thousandths of a millimeter.

10. The bar of claim 3 wherein said bar is:
- fifty-eight millimeters in length;
- fifteen millimeters wide; and
- one-hundred and fifty-six thousandths of a millimeter in thickness.

11. The lever latch of claim 3 wherein said lever latch is:
- forty-four millimeters in length.

12. The notches of claim 3 wherein said notches are:
- angled at forty five degrees.

13. The notches of claim 12 wherein said notches are:
- spaced four millimeters apart.

14. The notches of claim 13 wherein said notches are
- a height of one hundred and twenty-five thousandths of a millimeter.

15. A method of moving a capo from one fret to another fret comprising the steps of:
- obtaining a capo comprising of:
  - a bar with more than one notch and a slot;
  - a strap with a first end and a second end;
  - a hook with a curved head and a first strap fastener that is adjustably coupled to the first end of the strap;
  - a lever latch with at least one axle and a second strap fastener that is adjustably coupled to the second end of the strap;
  - wherein the notch(es) are operationally configured to pivotally receive the axle of the lever latch;
  - wherein the curved head of the hook is configured to engage the slot of the bar; and,
  - wherein pivoting the lever latch within the notch(es) while the curved head is engaged with the slot of the bar tautens the strap; and
- adjusting the second strap fastener to the second end of the strap.

16. The method of claim 15 by:
- adjusting the pivot point of the lever latch by moving the axle from one notch to a different notch.

17. The capo of claim 15 wherein the said strap fastener has more than one slot to couple the second end of the strap to the strap fastener.

18. A method of adjusting a capo from one application of pressure to barre the strings to another application of pressure to bane the strings comprising the steps of:
- obtaining a capo comprising of:
  - a bar with more than one notch and a slot;
  - a strap with a first end and a second end;
  - a hook with a curved head and a first strap fastener that is adjustably coupled to the first end of the strap;
  - a lever latch with at least one axle and a second strap fastener that is adjustably coupled to the second end of the strap;
  - wherein the notch(es) are operationally configured to pivotally receive the axle of the lever latch;
  - wherein the curved head of the hook is configured to engage the slot of the bar; and,
  - wherein pivoting the lever latch within the notch(es) while the curved head is engaged with the slot of the bar tautens the strap; and
- adjusting the second strap fastener to the second end of the strap.

19. The method of claim 18 by:

adjusting the pivot point of the lever latch by moving the axle from one notch to a different notch.

20. The capo of claim 18 wherein the said strap fastener has more than one slot to couple the second end of the strap to the strap fastener.

* * * * *